US006453573B1

(12) United States Patent
Arnold

(10) Patent No.: US 6,453,573 B1
(45) Date of Patent: Sep. 24, 2002

(54) RUBBER STAMP POSITIONING DEVICE

(75) Inventor: Robert Arnold, Spokane, WA (US)

(73) Assignee: EK Success, Ltd., NJ (US)

( * ) Notice: Subject to any disclaimer, the term of this patent is extended or adjusted under 35 U.S.C. 154(b) by 0 days.

(21) Appl. No.: 09/855,192

(22) Filed: May 14, 2001

Related U.S. Application Data

(60) Provisional application No. 60/217,149, filed on Jul. 8, 2000.

(51) Int. Cl.[7] ..... B41B 11/46

(52) U.S. Cl. ..... 33/622; 33/1 K; 33/474; 101/486

(58) Field of Search ..... 33/645, 613, 1 B, 33/1 K, 474, 479, 622; 101/327, 333, 405, 485, 486

(56) References Cited

U.S. PATENT DOCUMENTS 4,625,640 A * 12/1986 Bunger ..... 101/327
5,285,580 A * 2/1994 Christensen ..... 33/474
6,070,331 A * 6/2000 Dempsey ..... 33/479

* cited by examiner

*Primary Examiner*—Diego Gutierrez
*Assistant Examiner*—Travis Reis

(74) *Attorney, Agent, or Firm*—Sofer & Haroun, LLP

(57) ABSTRACT

The present invention provides for a stamp alignment device for use with a stamp having a height comprised of a base having first and second stamp guide edges. The first stamp guide edge and the second stamp guide edge connect in a substantially perpendicular manner creating an angled receiving area. At least one portion of each of the stamp guide edges is substantially higher than the height of the stamp mount. The stamp alignment device further comprises a non-slip surface attached to the bottom of the base and has a thickness. The non-slip surface has first and second non-slip surface guide edges that correspond to the first and second stamp guide edges of the base. Additionally, an image sheet is provided having a thickness less than the thickness of the non-slip surface. The image sheet has at least one substantially right angled corner configured to be placed into the first and second non-slip surface guide edges. Thus, when the image sheet is placed along the first and second non-slip surface guide edges, and the stamp is placed along the first and second stamp guide edges and pressed onto the image sheet, a reference image is deposited on the image sheet so that the image sheet can be moved across a substrate. Once the sheet is positioned the alignment device is brought into contact with the edges of the sheet, the sheet is removed and the alignment device is used to guide the stamp into position, aiding in the accurate placement of the stamped image.

18 Claims, 10 Drawing Sheets

RUBBER STAMP POSITIONING DEVICE

This application is based on U.S. Provisional Application No. 60/217,149 filed on Jul. 8, 2000, which is incorporated by reference herein as fully as if set forth in its entirety.

FIELD OF THE INVENTION

This invention relates to a rubber stamp positioning device. More specifically, this invention relates to a rubber stamp positioning device for accurately positioning an image from a rubber stamp on a substrate.

BACKGROUND OF THE INVENTION

There are many devices currently employed to accurately position images on a surface using rubber or plastic stamps or similar marking devices, hereinafter collectively referred to as stamps. Most stamps are produced from opaque materials such that the exact position of the stamping element cannot be seen as the stamp is being used, making exact placement of the stamped image difficult. Even if the stamp is transparent, it still may be difficult to achieve exact placement of the stamped image.

Various devices have been brought forth in an attempt to aid the user in positioning the stamped image. A typical positioning device consists of an inverted T or L shaped piece, typically fabricated from a piece of ½ inch thick clear plastic. Wood has also been used as the material for the positioning device. A sheet of clear plastic or translucent paper is positioned such that one corner is at the juncture of the horizontal and the vertical elements of the positioning device and the edges of the sheet are aligned to the edges of the positioning device. The stamp to be positioned is inked and aligned over the sheet with one corner at the juncture of the horizontal and vertical elements of the positioning device and its edges against the edges of the positioning device.

While being held against the edges of the positioning device, the stamp is moved downward to the surface of the sheet, imprinting a reference image. The sheet is then placed on the surface onto which the image is to be stamped and positioned such that the reference image is at a location on the surface where the stamped image is to be imprinted. While holding the sheet in position, the positioning device is brought back into position such that the edges are aligned against the edges of the sheet. While holding the positioning device in place, the sheet is removed, the stamp is re-inked, the stamp is placed against the edges of the positioning device and moved downward against the surface, stamping the image.

There are several problem associated with the construction and operation of the currently employed stamp positioning devices. Typically, the positioning devices currently available are constructed of acrylic plastic or smoothly finished wood, both of which have a low coefficient of friction, making them difficult to hold in place during use.

Another drawback in the current designs of stamp positioning devices is the height of the guide edges along which the stamp is placed, typically they are only slightly taller than the rubber die and mounting cushion of the stamp being positioned. This leads to difficulty in positioning the stamp against the guide edges in preparation for stamping. Frequently, because the stamp has to be held so close to the surface in order to be aligned against the short guide edges of the positioning the device, it is not uncommon that the stamp will inadvertently contact the surface before it is properly aligned. It is also not uncommon that in the act of lowering the stamp along the short guide edges that pressure applied by the user that is not completely vertical will force the top of the stamp to angle over the guide edges and cause the stamped image to be mis-positioned.

In another example of a problem associated with the prior art, typically the guide edges of the positioning device are both relatively long compared with the stamp or stamp mount. As such, because the stamps are normally grasped along opposing edges, one of the edges of the positioning devices usually interferes with the user's grasp on the stamp while they hold it along the guide edge.

In yet another example of a short coming found in the prior art of the stamp positioning devices, the use of heavy clear plastic materials to construct the positioning sheet frequently leads to misplaced stamped images. When using such sheets, which typically are an ⅛ inch thick, the reference image is of great enough distance from the intended surface that, if the user is not directly over top of the reference image, the resulting parallax can easily result in the final image being placed improperly. In the past, alternative reference sheets have been constructed of a thin translucent paper, such as tracing paper. However, the use of materials like these frequently leads to poor results either because the paper is folded or bent, or it slips under the guide edges.

Thus, there exists a need in the field of crafts, particularly in the field of stamp positioning devices to provide a more accurate means of positioning a stamp image on a surface.

SUMMARY

The present invention looks to overcome the drawbacks associated with the prior art. More specifically, the present invention provides a stamp positioning device having first and second guide edges, where the guide edges are tall enough to allow placement of the stamp against the guides without the likelihood of accidently marking the substrate before the stamp is positioned. In addition, the first or main guide edge, is much longer in length than the second, such that the first guide edge extends for length sufficient, so as to provide stability to the device during use. The second guide edge, is shorter than the edge of the stamp or stamp mount, such that when a user grips the stamp mount with their fingers and thumb positioned on opposite sides of the stamp, the shorter second guide edge will not interfere with the user's grasp when positioning the stamp.

The present invention also provides a non-slip base attached to the bottom of the device which provides better contact with the work surface, thus reducing accidental slippage during operation.

Additionally, the present invention provides for a thin plastic sheet which is significantly thinner that the standard ⅛" plastic sheets used in the prior art. This thickness is such that it will not create substantial parallax, even if the user is viewing the reference image from an angle other than perpendicular to the working surface. However, the plastic sheet is also of a thickness and sturdiness greater than that of tracing paper or other comparable materials so as to provide stability.

To this end the present invention provides for a stamp alignment device for use with a stamp having a height comprised of a base having first and second stamp guide edges. The first stamp guide edge and the second stamp guide edge connect in a substantially perpendicular manner creating an angled receiving area. At least one portion of each of the stamp guide edges are tall enough to allow placement of the stamp against the guides without the likelihood of accidently marking the substrate before the stamp is positioned.

The stamp alignment device further comprises a non-slip surface attached to the bottom of the base and has a thickness. The non-slip surface has first and second non-slip surface guide edges that correspond to the first and second stamp guide edges of the base.

Additionally, a reference sheet is provided having a thickness no greater than the thickness of the non-slip surface. The reference sheet has at least one substantially right angled corner configured to be placed into the first and second non-slip surface guide edges. Thus, when the reference sheet is placed along the first and second non-slip surface guide edges, and the stamp is placed along the first and second stamp guide edges and pressed onto the reference sheet, a reference image is deposited on the reference sheet so that the reference sheet can be moved across a substrate.

DETAILED DESCRIPTION

Figure 1A:
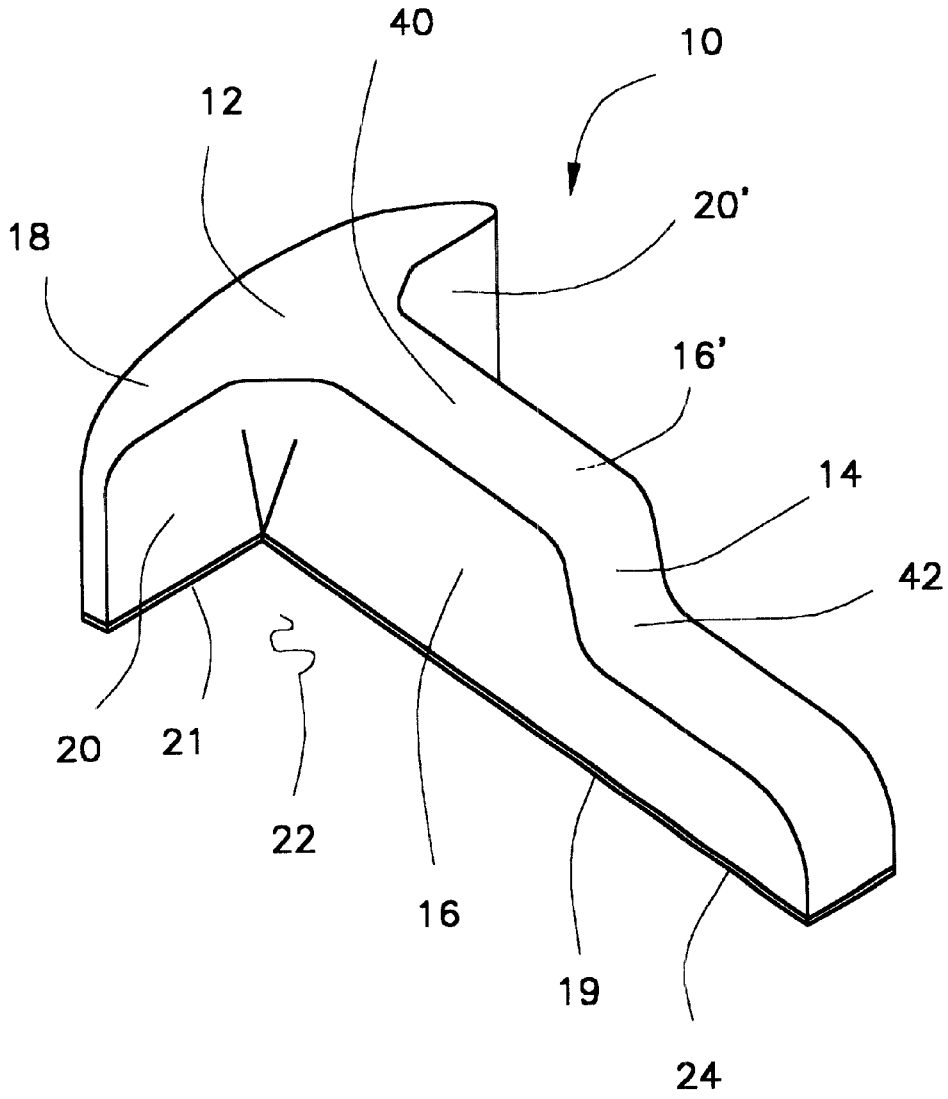
FIG. 1A is an angled elevation view of a stamp positioning device, in accordance with one embodiment of the present invention.

In one embodiment of the present invention, a stamp positioning device 10 is comprised of a base 12 having a main segment 14 having at least one first stamp guide edge 16. Base 12 also has a cross segment 18, having at least one second stamp guide edge 20 disposed thereon, extending away from first stamp guide edge 16 at a substantially perpendicular angle. A non-slip surface 24 is attached to the underside of base 12 such that it extends across the under surface of base 12 forming first and second non-slip surface guide edges 19 and 21. An image sheet 26 is provided for positioning within image sheet receiving area 22, upon which a reference image 28 is placed using stamp 30. Contoured areas provide gripping surfaces at the front 40 and top 42 of the positioning device.

Structure

Figure 1B:
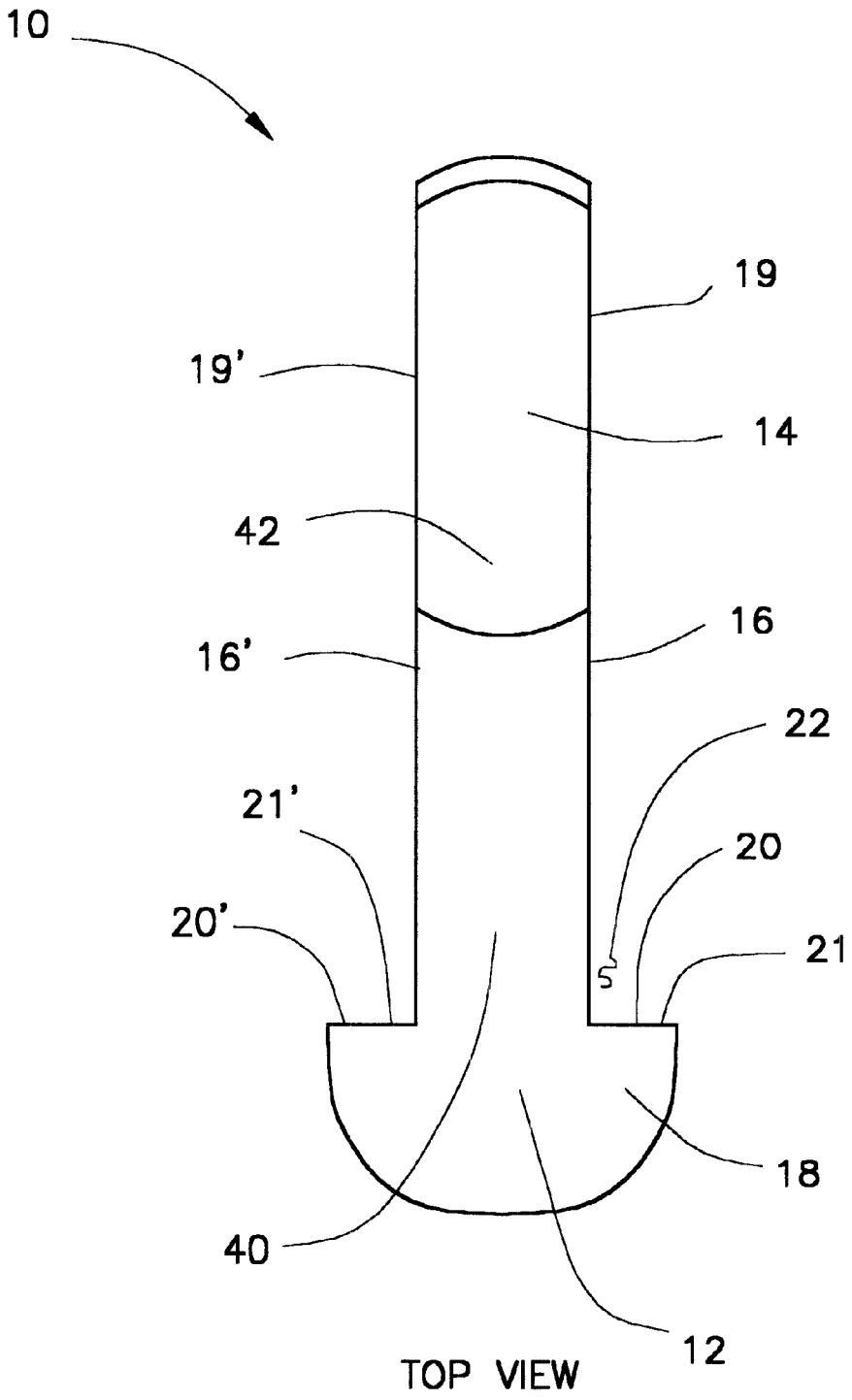
FIG. 1B is a plan view of a stamp positioning device in accordance with one embodiment of the present invention.

In one embodiment of the present invention as illustrated in FIG. 1, base 12 is composed of main segment 14 having at least one first stamp guide edge 16 disposed thereon and a cross segment 18 having at least one second stamp guide edge 20. For the purposes of illustrating the salient features of the structure of the present invention, first stamp guide edge 16 of main segment 14 and second stamp guide edge 20 of cross segment 18 will be used to discuss the structure and dimensions of base 12 of device 10, as these two component portions of device 10 comprise the principal functional aspects of base 12. References to main segment 14 and cross segment 18 which form first stamp guide edge 16 and second stamp guide edge 20 respectively will only be used as necessary. FIG. 1A provides a top view of device 10 so as to provide a more detailed view of the features of device 10.

First stamp guide edge 16 is approximately 3"–6" inches and preferably 4½" inches long, however it can be of any length substantially suited to provide a guide edge to image sheet 26. The stamp mount 32 and first stamp guide edge 16 is approximately ¾"–1½" inches and preferably 1¼" inches in height, however any height can be used so as long a portion of the edge located near the connecting point with second stamp guide edge 20 is at least tall enough to permit the stamp to be accurately positioned against the guide edges 16 and 20 and still provide adequate clearance between the inside surface of stamp 30 and the surface upon which it will be imported, for all of the stamps 30 that are intended to be used with device 10. The bottom of base 12 of device 10 must be essentially flat where it meets substrate 36 to prevent image sheet 26 from sliding under guide edges 16 and 20.

The height of first guide edge 16 can vary along the length of main segment 14, as seen in FIG. 1, so long as the portion located nearer to the intersection of first and second guide edge 16 and 20 is sufficiently tall enough to allow proper placement of stamp mount portions 32 of stamps 30. To this end, the heights of first stamp guide edge 16 can vary in size in several permutations of device 10 such that each of the permutations of device 10 are intended to be used with a different style/height stamps 30.

In one embodiment of the present invention, main segment 14 is approximately ¾"–1 ¼" inches and preferably 1" wide such that two first guide edges 16 and 16' are formed having smooth, linear surfaces. The upper surface of main segment 14 can be of any contour, either flat, smooth, rounded or rough, which ever provides the user with proper comfort and ease of use during operation. The variation in height along the length of main segment 14 also provides a contoured upper surface having front 40 and top 42 gripping surfaces. As illustrated in FIG. 1A, the smooth side surfaces, which form first guide edges 16 and 16' are substantially vertical relative to the work surface.

For the purposes of illustration of the salient features of the present invention, first stamp guide edge 16 will be discussed alone, however, it should be noted that first stamp guide edge 16' maintains the same structure and function so long as it substantially conforms to the above described dimensions. The base of th device must be essentially flat where it meets the working surface/substrate to prevent the imaging sheet from sliding under the guide edge.

In one embodiment of the present invention, as illustrated in FIG. 1, second stamp guide edge 20 disposed on cross segment 18 is disposed substantially perpendicular to first stamp guide edge 16, forming a substantially 90 degree angle at their intersection point. Second stamp guide edge 20 is approximately ⅜"–⅝" inches and preferably ½" long the length of cross segment 18, in one direction extending away from the intersection with first stamp guide edge 16.

The length of second stamp guide edge 20 may vary, but it is typically a length significantly smaller than that of stamp 30 or stamp mount portions 32 for stamps 30 that are intended to be used with device 10. This configuration prevents second stamp guide edge 20 from interfering with a user's fingers gripping stamp 30 or stamp mount portion 32. As with first stamp guide edge 16, various permutations of second stamp guide edge 20 may vary size depending on the size of stamp 30.

In one embodiment of the present invention, also illustrated in FIGS. 1 and 1A, cross segment 18 can extend perpendicular to main segment 14 in more than one direction. For example, cross segment 18 extends across the width of main segment 14 so as to create two second guide edges 20 and 20'. Second stamp guide edge 20', as pictured, is a mirror image of second stamp guide edge 20 including non-slip surface guide edges 19' and 21', thus allowing for device 10 to be used easily by both left and right handed users.

Alternatively, (not pictured) second stamp guide edge 20' may be different in length, and other dimensions, from second stamp guide edge 20. Although they maintain substantially the same function, second stamp guide edge 20' could be used with different style or size stamps 30, assuming of course that first stamp guide edge 16' is also of comparable dimensions. For the purposes of illustrating the salient features of the present invention, first stamp guide edge 16 and second stamp guide edge 20 and reference sheet receiving area 22 formed by them will be used.

Second stamp guide edge 20, approximately ¾"–1 ½' inches in height and preferably 1¼", is at least as tall as stamp 30 intended to be used with base 12. Second stamp guide edge 20 is shorter in length than stamp 30 but it is at least as tall as stamp 30 near the intersection point with first stamp guide edge 16 and for most if its length along cross segment 18, so as to provide stability to stamp 30 and stamp mount 32 during operation. As illustrated in FIG. 1A, second stamp guide edge 20 is substantially vertical along its height.

Cross segment 18 is approximately ½"–1" inch thick, however this can vary according to various permutations of base 12. In fact, the side opposite of second stamp guide edge 20 does not have to be flat or vertical along its height so the thickness of cross segment 18 can vary along its length, even on a single device.

Figure 2:
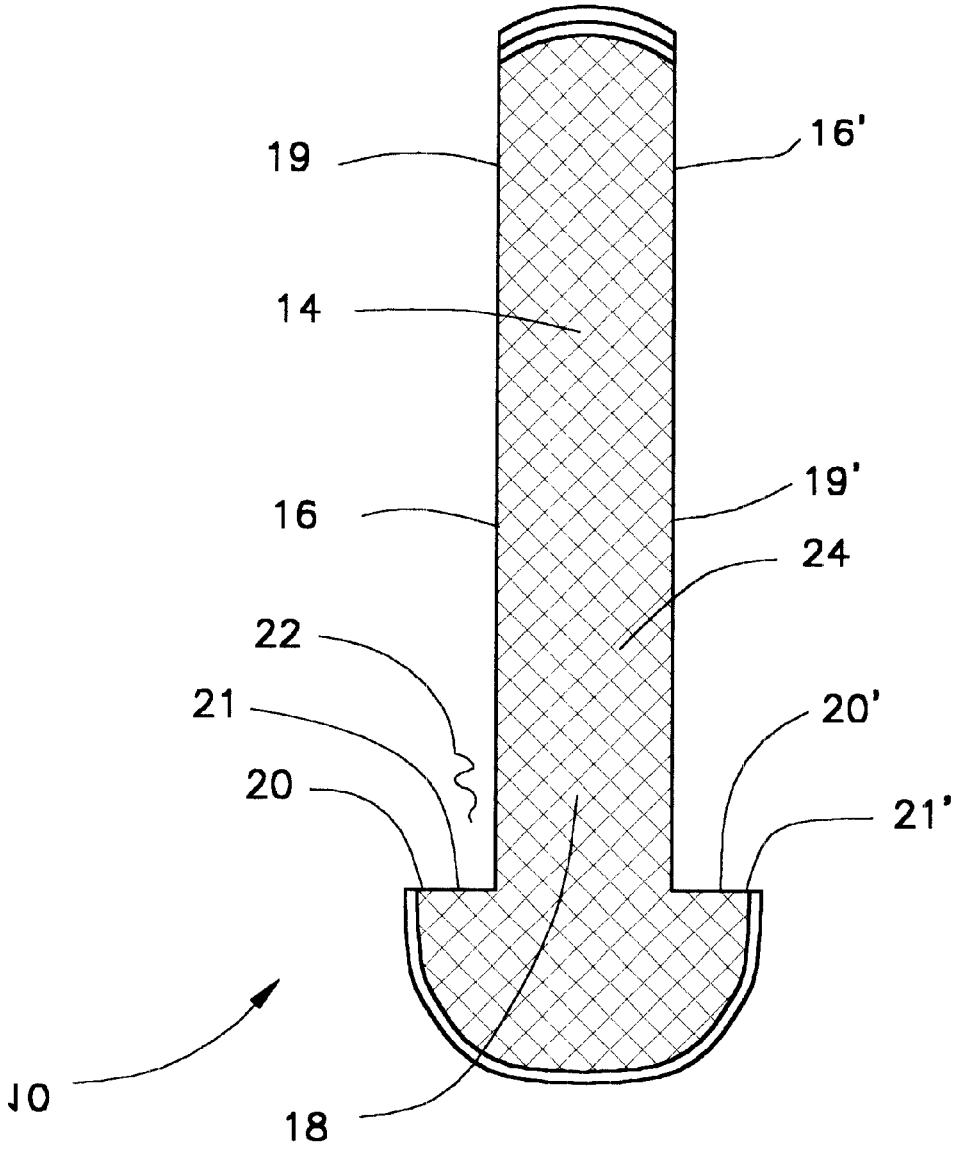
FIG. 2 is a under side plan view of a stamp positioning device in accordance with one embodiment of the present invention.

In one embodiment of the present invention, as illustrated in FIG. 2, non-slip surface 24 is attached to the underside of base 12 so as to provide friction between base 12 and the work surface so that base 12 does not slip during operation. Non-slip surface 24 is a firm material with a relatively high coefficient of friction such as high density rubber or a E.V.A. compound and is approximately 1 mm thick, attached via a pressure sensitive adhesive. However, it should be noted that non-slip surface 24 can be constructed of any suitable material which would prevent base 12 from sliding on the work surface during use.

Non-slip surface 24 should be thin relative to the height of first and second stamp guide edges 16 and 20. Non-slip surface 24 can be manufactured to be a part of base 12, or it can be affixed after manufacture. The material, can be of any substance that displays appropriate qualities. The thickness of non-slip surface 24, although preferably 1 mm may vary so long as it performs its intended function, however, non-slip surface 24 should be thicker than image sheet 26.

Non-slip surface 24 covers almost all of the under surface of base 12 creating first and second non-slip surface edges 19 and 21 respectively. Edges 19 and 21 of non-slip surface 24 line up along the same plane as first stamp guide edge 16 and second stamp guide edge 20. This configuration forms a continuous contiguous edge between guide edges 16 and 20 and first and second non-slip surface edges 19 and 21 of non-slip surface 24 such that first stamp guide edge 16 and second stamp guide edge 20 extend not only the height of main segment 14 and cross segment 18 respectively but additionally the height of non-slip surface 24. It should be noted that non-slip surface 24 does not need to cover the entire bottom of base 12, so long as it provides a good non-slip agent to base 12 and provides first and second non-slip surface guide edges 19 and 21 contiguous with first and second stamp guide edges 16 and 20.

In one embodiment of the present invention, at the meeting point of first and second nonslip surface guide edges 19 and 21 as they exist substantially planer with first and second stamp guide edges 16 and 20, an image sheet receiving area 22 is formed so as to receive reference sheet 26. As illustrated in FIGS. 1, 1A and 2, image sheet receiving area 22 is substantially 90 degrees, however, it should be noted that any angle can be used which compliments the shape of the intended stamp 30 and stamp mount portion 32.

In one embodiment of the present invention, image sheet 26 is approximately 1 mm inches thick, between 5"–7" inches square and is constructed of polypropylene sheet, one side being essentially smooth and the other side being lightly textured. The purpose of the textured side is to reduce the beading up of water based dye inks on the surface of sheet 26, thereby rendering the stamped image more visible on the sheet. However, it should be noted that, image sheet 26 can be constructed of similar material and of similar size so long as it can maintain the functions required by device 10. For example, image sheet 26 can be of varying thickness, so long as it is not as thick as non-slip surface 24 and not to thick so as to cause significant parallax when a user views of reference image 28 from an angle other than perpendicular to the work surface. Likewise, image sheet 26 can be constructed of any material that is transparent or translucent and is capable of receiving reference image 28 from stamp 30. Also, image sheet 26 can be of many different shapes so long as it has at least one region that is substantially complementary to image sheet receiving area 22, which, as illustrated in FIGS. 1, 1A and 2, is a 90 degree corner.

For the purposes of illustrating the salient features of the present invention, image sheet 26, is square with all four corners are 90 degrees and thus complimentary to image sheet receiving area 22.

Figure 3:
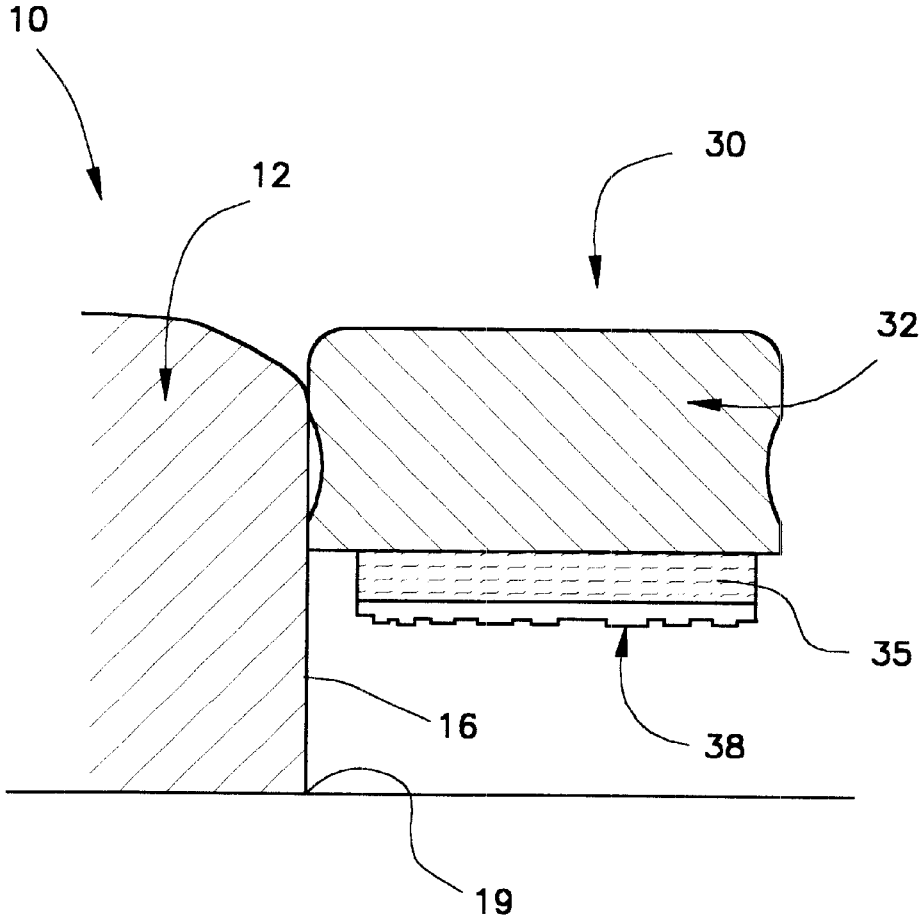
FIG. 3 is an elevation view of stamp and a stamp positioning device, in accordance with one embodiment of the present invention.

In one embodiment of the present invention, as illustrated in FIG. 3, stamp 30 refers to any stamp 30 which is designed to imprint an image 34 onto a substrate 36. Stamp, 30 maintains a stamp die 38 which is preferably composed of rubber although it can be of any made of similar materials such as plastic or other materials. Die 38, which is attached to mount portion 32 via a stamp cushion 35, is used to stamp image 34 onto substrate 36 and to stamp reference image 28 onto image sheet 26.

Stamp 30 also maintains stamp mount portion 32. Mount portion 32 is the portion of stamp 30 which is placed in along guide edges 16 and 20 so as to place images 28 and 34 onto their respective destinations as will be discussed below. The shape of mount portion 32 is preferably complementary to the angle of intersection between first and second stamp guide edges 16 and 20 such that the edges of mount portion 32 line up against first stamp guide edge 16 and second stamp guide edge 20 allowing for proper positioning of images 28 and 34. For the purposes of illustration, mount portion 32 is square such that it readily conforms with the 90 degree angle formed by first stamp guide edge 16 and second stamp guide edge 20 at image sheet receiving area 22.

It should be noted that it is merely advantageous that stamp mount portion 32 be complementary to the angle of intersection between first and second guide edges 16 and 20, and that other mount portion 32 shapes that can be used with consistency. For example, if stamp mount portion 32 were octagonal it would still be able to be used in base 12 even if the meeting position of first stamp guide edge 16 and second stamp guide edge 20 form a 90 degree square angle. In fact, even a circular stamp mount portion 32 could be used in a 90 degree angled base 12, however, it would be important to keep track of the facing of die 38. For illustrative purposes in demonstrating the salient features of the present invention, stamp mount portion 32 will be square, however, this is in no way intended to limit the scope of the present invention.

Operation

Figure 4:
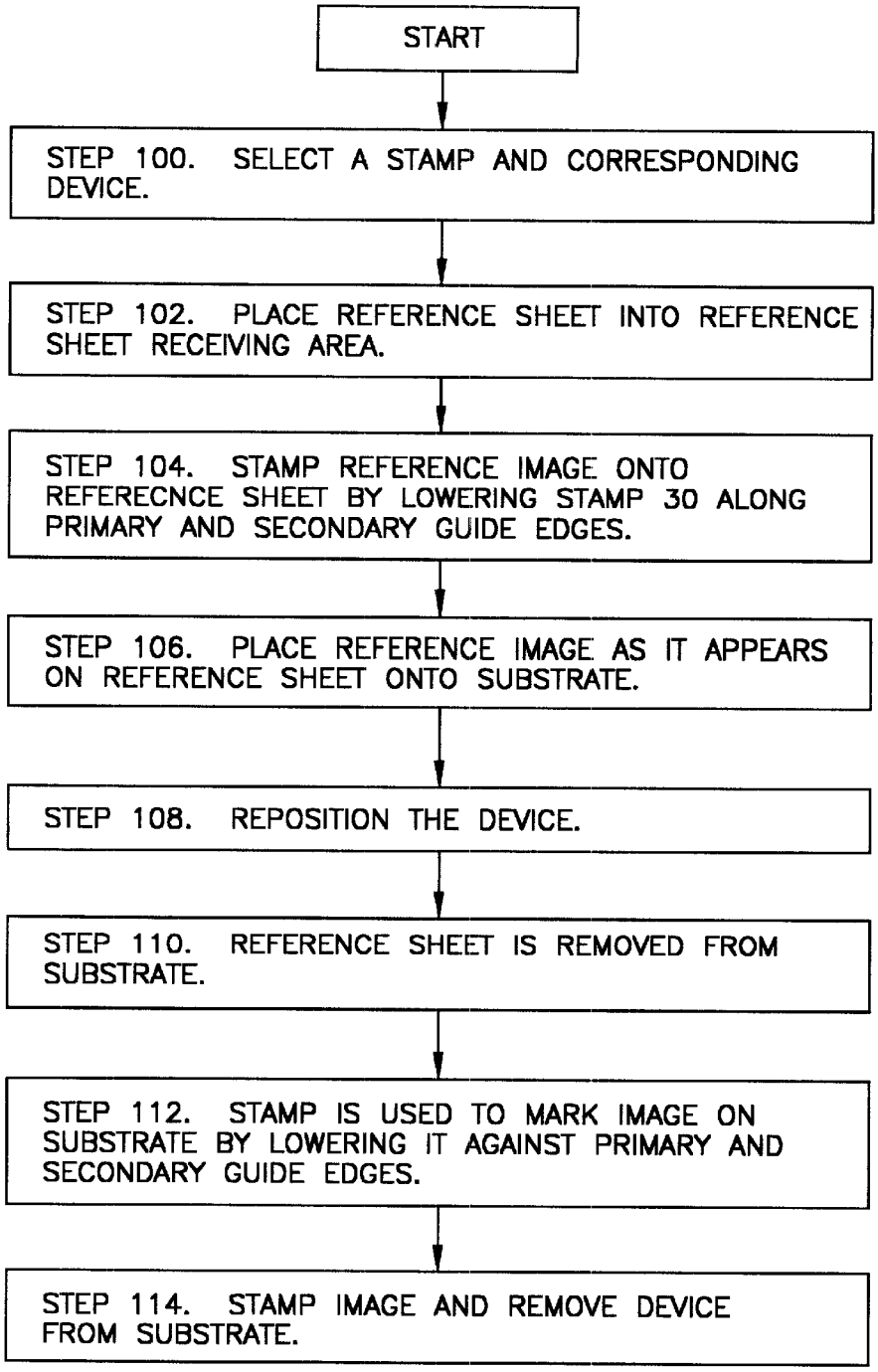
FIG. 4 is a flow chart for the operation of a stamp positioning device, in accordance with one embodiment of the present invention.

In one embodiment of the present invention, as illustrated in flow chart FIG. 4, at a first step 100, the user selects a stamp 30 and a base 12 of appropriate size and dimension to accommodate stamp 30.

Figure 5:
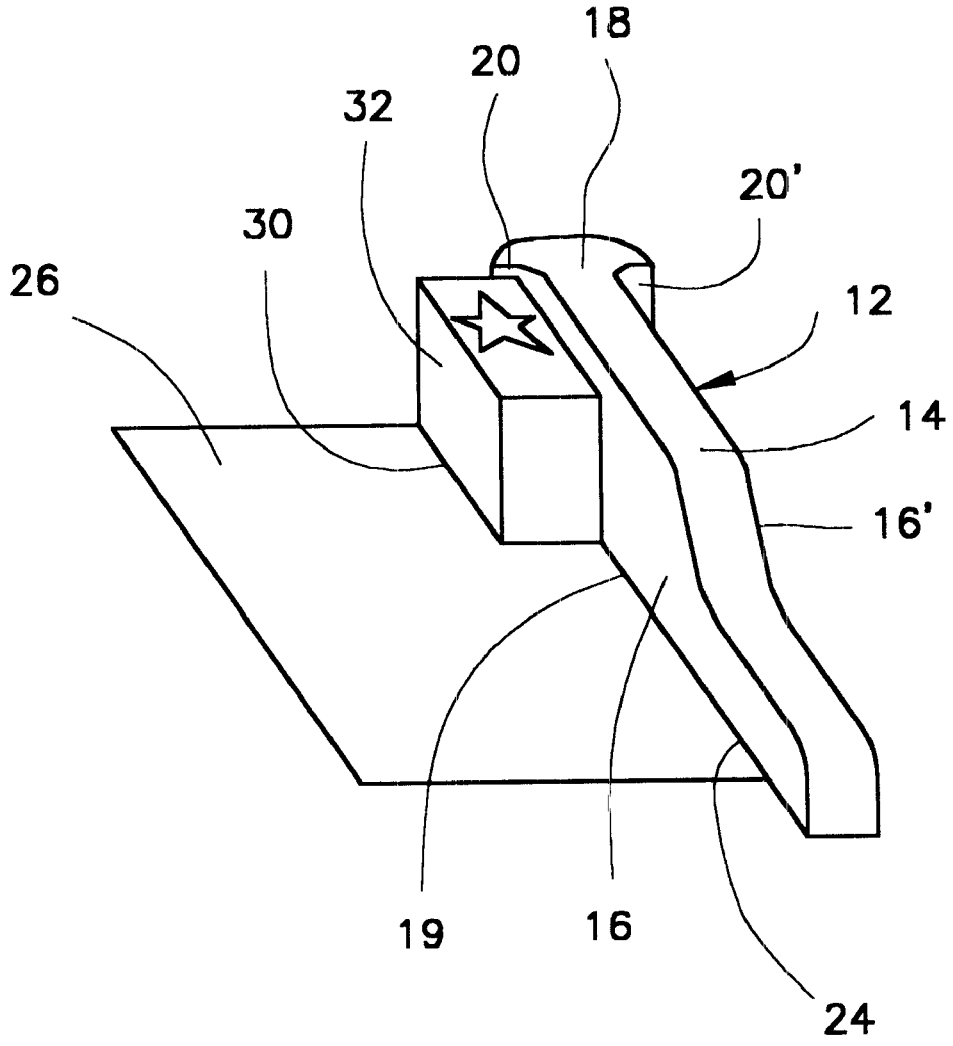
FIG. 5 is an illustration of a stamp positioning device, stamp and a reference sheet as positioned during operation in accordance with one embodiment of the present invention.

Next, at step 102, as illustrated in FIG. 5, the user places base 12 and image sheet 26 onto a work surface. Image sheet 26 is slid into position into image sheet receiving area 22 so that at least one corresponding corner is abutted against first and second non-slip surface guide edges 19 and 21 which extend contiguous with first and second stamp guide edges 16 and 20 down to the work surface.

Once image sheet 26 is in position, at step 104, stamp 30 is inked and placed firmly against first and second stamp guide edges 16 and 20 and lowered onto image sheet 26, thus stamping reference image 28 onto sheet 26. For the most effective results, second stamp guide edge 20 is shortened, as described above, such that when a user is gripping stamp 30 on opposite sides of mount portion 32, the fingers are positioned on stamp 30 on the edge away from second stamp guide edge 20 and the thumb is positioned on stamp 30 on the edge against second stamp guide edge 20. Because second stamp guide edge 20 is cut away for some portion of stamp 30 and mount portion 32, the user's thumb will have enough room to securely hold and lower stamp 30 against image sheet 26 and not accidently push the stamp away from second stamp guide edge 20.

When stamping reference image 28 onto image sheet 26, the position of base 12 and sheet 26 on the work surface is irrelevant so long as base 12 and sheet 26 are properly aligned to each other. These steps are not used to place stamp 30 onto substrate 36 but are merely used to gauge the final position of stamp 30 relative to first stamp guide edge 16 and second stamp guide edge 20 when it is used in conjunction with base 12. However, it is important that image sheet 26 is firmly abutted against first and second non-slip surface guide edges 19 and 21 of non-slip surface 24 as they are disposed contiguous with first and second stamp guide edges 16 and 20. Also, reference image 28 is stamped, mount portion 32 of stamp 30 is flush against first and second stamp guide edges 16 and 20.

Figure 6:
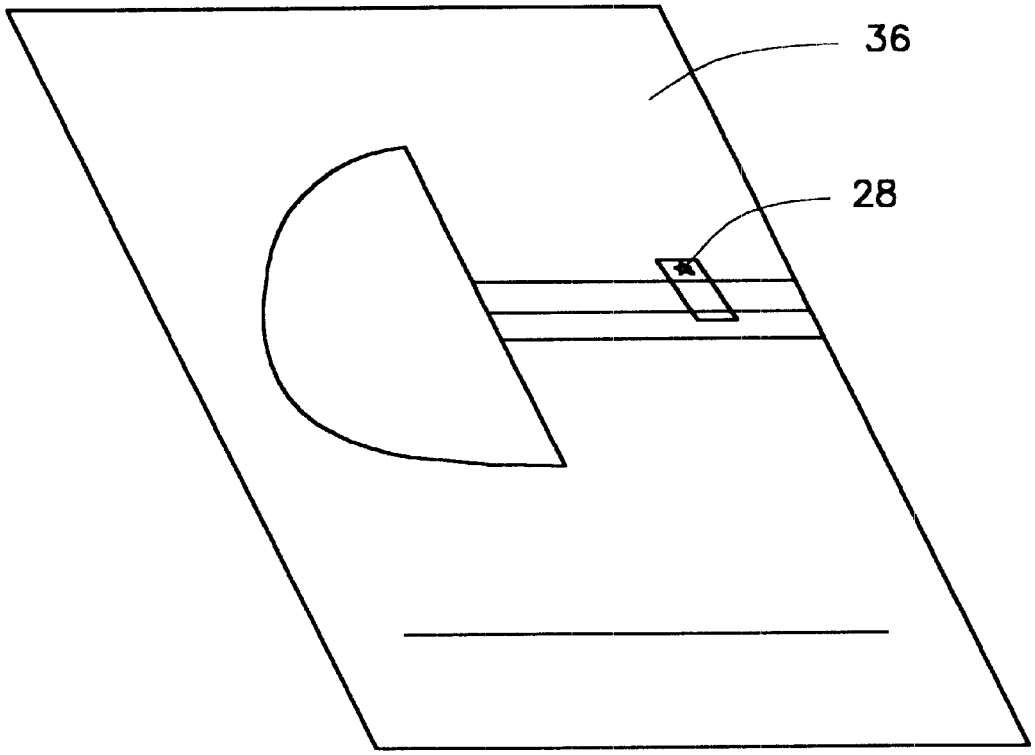
FIG. 6 is an illustration of a reference sheet and a substrate as positioned during operation in accordance with one embodiment of the present invention.
Figure 7:
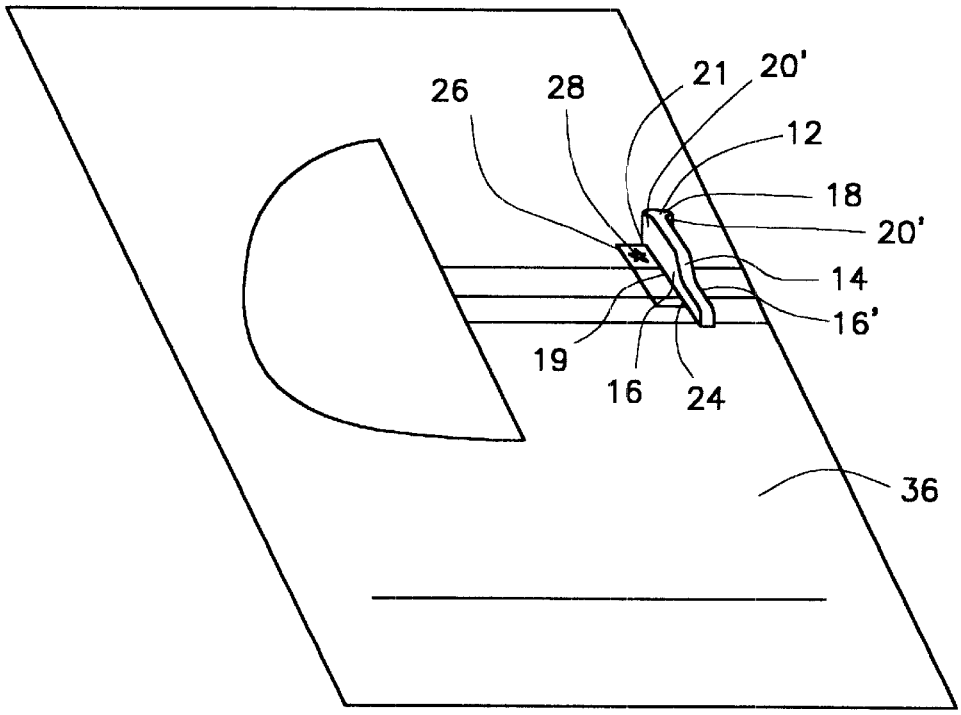
FIG. 7 is an illustration of a reference sheet, a substrate, and a stamp positioning device as positioned during operation in accordance with one embodiment of the present invention.

Next at step 106, as illustrated in FIG. 6, after reference image 28 is placed on image sheet 26, substrate 36 is placed onto the work surface. Image sheet 26 is then placed on top of substrate 36. Because image sheet 26 is made of a transparent or translucent plastic-like substance, substrate 36 is viewable through image sheet 26. This allows the user to position reference image 28 exactly where they wish image 34 to eventually appear.

After reference image 28 is properly positioned on substrate 36, at step 108, as illustrated in FIG. 6, base 12 is repositioned against image sheet 26 such that image sheet 26 is again located in reference sheet receiving area 22 with its edges resting squarely against first and second non-slip surface edges 19 and 21 of non-slip surface 24. Next, at step 110, image sheet 26 is removed from substrate 36 while base 12 is held firmly in place with the aid of non-slip surface 24.

Figure 8:
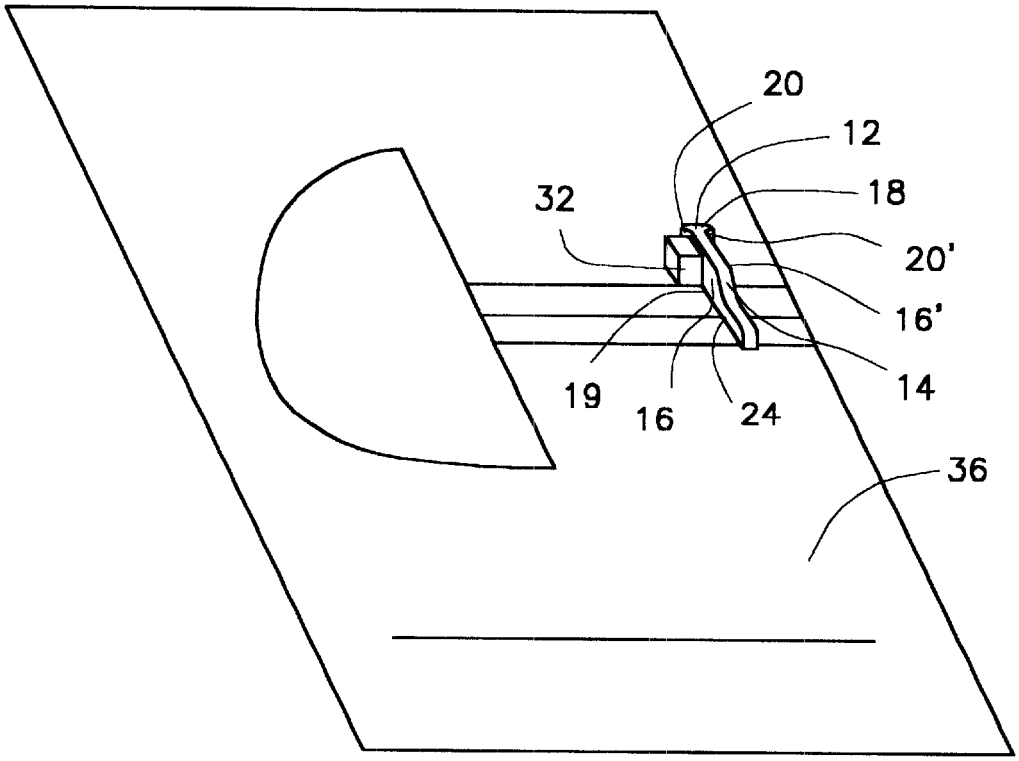
FIG. 8 is an illustration of stamp, a substrate and a stamp positioning device as positioned during operation in accordance with one embodiment of the present invention.
Figure 9:
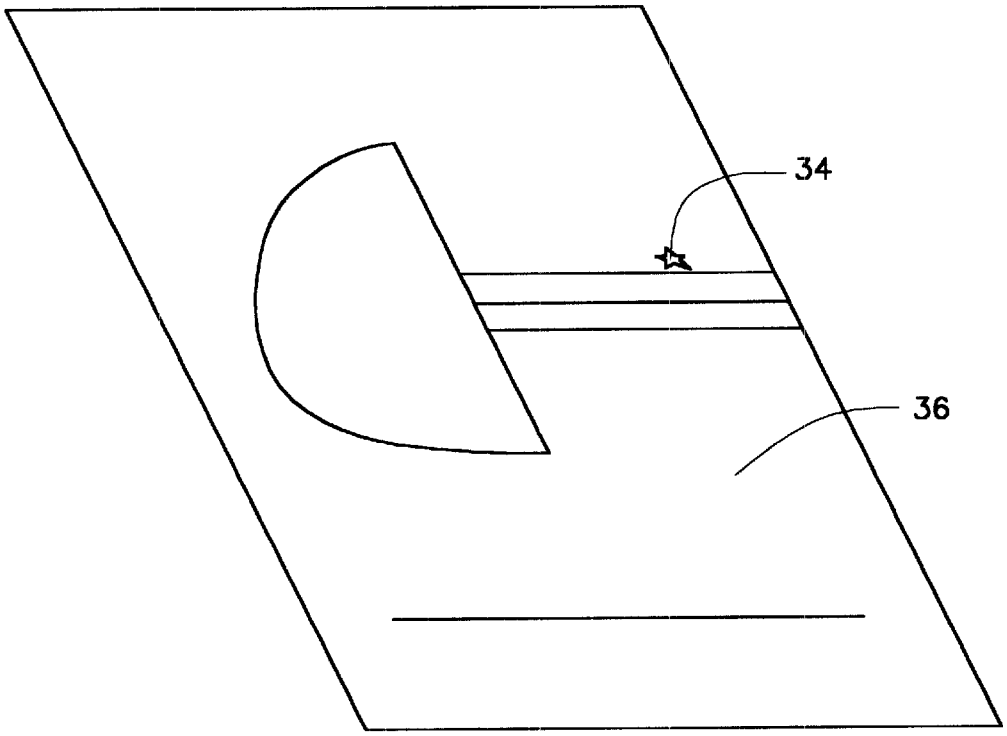
FIG. 9 is an illustration of substrate with a stamped image thereon at a final stage of operation in accordance with one embodiment of the present invention.

With image sheet 26 removed, at step 112, stamp 30 is inked and lowered along first and second stamp guide edges 16 and 20 onto substrate 36, as illustrated in FIG. 8. As described above, stamp 30 and mount portion 32 are carefully held flush against first and second stamp guide edges 16 and 20. Lastly, at step 114, as illustrated in FIG. 9, base 12 and stamp 30 are removed from substrate 36 leaving image 34 in its proper place.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A stamp alignment device for use with a stamp having a height, the device comprising:

a base having first and second stamp guide edges, said first stamp guide edge and said second stamp guide edge connecting in a substantially perpendicular manner creating an angled receiving area, wherein at least a portion of both said first and second stamp guide edges are substantially higher than the height of the stamp;

a non-slip surface attached to the bottom of said base and having a thickness, said non-slip surface having first and second non-slip surface guide edges that correspond to said first and second stamp guide edges of said base; and an image sheet, having a thickness substantially less than said thickness of said non-slip surface, said image sheet having at least one substantially right angled corner configured to be placed into said first and second non-slip surface guide edges so that when said image sheet is placed along said first and second non-slip surface guide edges, and the stamp is placed along said first and second stamp guide edges and pressed onto said image sheet, a reference image is deposited on said image sheet so that said image sheet can be moved across a substrate.

2. A stamp alignment device as claimed in claim 1, wherein said base is constructed of plastic.

3. A stamp alignment device as claimed in claim 1, wherein said first stamp guide edge is substantially 4½" inches in length.

4. A stamp alignment device as claimed in claim 1, wherein said second stamp guide edges is substantially ½" inches in length.

5. A stamp alignment device as claimed in claim 1, where in said first stamp guide edge is substantially 1¼" inches in height.

6. A stamp alignment device as claimed in claim 1, wherein said second stamp guide edge is substantially 1¼" inches in height.

7. A stamp alignment device as claimed in claim 5, wherein said first stamp guide edge is substantially 1¼" inches in height at a first portion disposed proximal to said second stamp guide edge and tapers down to substantially ⅝" inches in height at a second portion disposed distal to said second stamp guide edge.

8. A stamp alignment device as claimed in claim 1, wherein said non-slip surface is composed of a rubber material having a high coefficient of friction and low compressibility.

9. A stamp alignment device as claimed in claim 1, where in said non-slip surface is substantially 1 mm inches thick.

10. A stamp alignment device as claimed in claim 1, wherein said first and second non-slip surface guide edges are co-planer with said first and second stamp guide edges.

11. A stamp alignment device as claimed in claim 1, wherein said image sheet is constructed of plastic.

12. A stamp alignment device as claimed in claim 1, wherein said image sheet is transparent.

13. A stamp alignment device as claimed in claim 1, wherein said image sheet is substantially square.

14. A stamp alignment device as claimed in claim 1, wherein said image sheet is substantially less than or equal to said thickness of said non-slip surface.

15. A stamp alignment device as claimed in claim 1, wherein said image sheet is substantially ½ mm thick.

16. A stamp alignment device as claimed in claim 1, wherein said base further comprises third and fourth stamp guide edges and third and fourth non-slip surface guide edges, wherein said third stamp guide edge and said third non-slip surface guide edge run parallel to said first stamp guide edge and said first non-slip surface guide edge, and where said fourth stamp guide edge and said fourth non-slip surface guide edge run substantially linear to said second stamp guide edge and said second non-slip surface guide edge such that the device can be operated by both right handed and left handed users.

17. A stamp alignment device as claimed in claim 1, wherein said image sheet with said reference image disposed thereon is configured to be positioned on said substrate such that once said image sheet is in position, said first and second non-slip base guide edges of said base are placed against said properly positioned image sheet on said substrate.

18. A stamp alignment device as claimed in claim 17, wherein said base, as positioned on said substrate by way of said reference sheet, is configured to provide a means for positioning the stamp such that a final image can be stamped on said substrate using the stamp and said first and second stamp guide edges.

* * * * *